US009217298B2

(12) United States Patent
Lafuente et al.

(10) Patent No.: US 9,217,298 B2
(45) Date of Patent: Dec. 22, 2015

(54) HOLDING DEVICE INSERTABLE INTO THE CENTRAL BORE OF A TUBULAR DRILL STRING COMPONENT, AND CORRESPONDING TUBULAR DRILL STRING COMPONENT

(75) Inventors: Marta Lafuente, Barcelona (ES); Francois Pineau, Lille (FR); Gabriel Roussie, Valenciennes (FR)

(73) Assignee: VAM DRILLING FRANCE, Cosne Cours sur Loire (FR)

( * ) Notice: Subject to any disclaimer, the term of this patent is extended or adjusted under 35 U.S.C. 154(b) by 49 days.

(21) Appl. No.: 13/318,530

(22) PCT Filed: May 7, 2009

(86) PCT No.: PCT/IB2009/006284

§ 371 (c)(1),
(2), (4) Date: Nov. 2, 2011

(87) PCT Pub. No.: WO2010/128351

PCT Pub. Date: Nov. 11, 2010

(65) Prior Publication Data

US 2012/0048623 A1 Mar. 1, 2012

(51) Int. Cl.
*F16L 55/00* (2006.01)
*E21B 17/02* (2006.01)

(52) U.S. Cl.
CPC ..... *E21B 17/028* (2013.01)

(58) Field of Classification Search
CPC ..... F16L 11/12; F16L 11/20; F16L 11/22; F16L 57/06; F16L 3/06; F16L 3/123
USPC ..... 138/108, 98, 104, 110
See application file for complete search history.

(56) References Cited

U.S. PATENT DOCUMENTS

| | | | | |
|---|---|---|---|---|
| 1,668,953 | A * | 5/1928 | Erickson | 174/101 |
| 3,758,701 | A * | 9/1973 | Schmidt | 174/28 |
| 4,327,775 | A * | 5/1982 | Tally | 138/103 |
| 4,400,858 | A * | 8/1983 | Goiffon et al. | 24/546 |

(Continued)

FOREIGN PATENT DOCUMENTS

| | | |
|---|---|---|
| GB | 2 433 080 | 6/2007 |
| RU | 2 384 702 C2 | 4/2006 |

OTHER PUBLICATIONS

International Search Report Issued Feb. 5, 2010 in PCT/IB09/006284 Filed May 7, 2009.

*Primary Examiner* — James Hook
(74) *Attorney, Agent, or Firm* — Oblon, McClelland, Maier & Neustadt, L.L.P.

(57) ABSTRACT

A holding device insertable into a central bore of a drill string component, the central bore having a first diameter along at least part of a central portion of the drill string component and a second diameter proximate ends of the drill string component. The second diameter is lower than the first diameter. The holding device includes an elongated body forming at least partly a housing for a transmission line. The elongated body has transversal dimensions lower than the second diameter. A plurality of arcuate elements are arranged along the elongated body and distinct from and attached to the elongated body. The arcuate elements are elastically bendable so as to be able to move through the second diameter and have a largest chord greater than the first diameter in a free state so as to be able to expand within the first diameter once past the second diameter.

23 Claims, 2 Drawing Sheets

(56) References Cited

U.S. PATENT DOCUMENTS

| | | | | |
|---|---|---|---|---|
| 5,435,351 | A * | 7/1995 | Head | 138/111 |
| 5,992,468 | A * | 11/1999 | Dwiggins | 138/108 |
| 6,557,589 | B2 * | 5/2003 | Bozic et al. | 138/106 |
| 6,604,549 | B2 * | 8/2003 | Gauthier et al. | 138/108 |
| 6,641,434 | B2 | 11/2003 | Boyle et al. | |
| 6,723,266 | B1 * | 4/2004 | Lippiatt | 264/173.17 |
| 7,040,415 | B2 | 5/2006 | Boyle et al. | |
| 7,857,009 | B2 * | 12/2010 | Groβ | 138/110 |
| 2001/0043839 | A1 * | 11/2001 | Prusak | 405/184.2 |
| 2002/0170612 | A1 * | 11/2002 | Penza | 138/108 |
| 2005/0115017 | A1 | 6/2005 | Kim | |
| 2005/0115717 | A1 | 6/2005 | Hall et al. | |
| 2007/0159351 | A1 | 7/2007 | Madhavan et al. | |
| 2007/0169929 | A1 | 7/2007 | Hall et al. | |
| 2008/0106433 | A1 | 5/2008 | Madhavan et al. | |
| 2008/0178956 | A1 * | 7/2008 | Willingham | 138/108 |

* cited by examiner

Fig.4
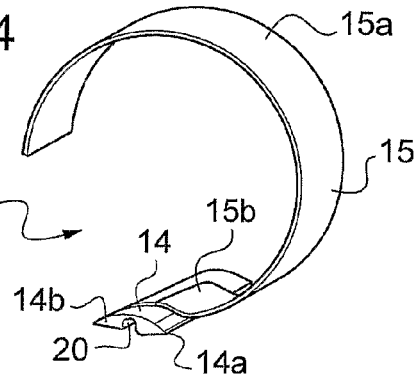
Fig.5
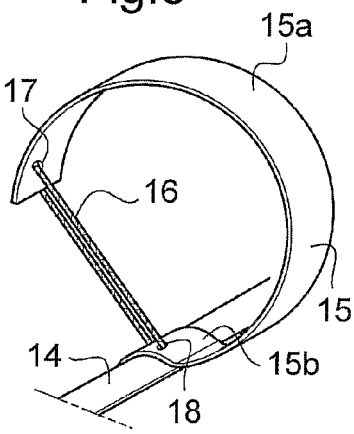
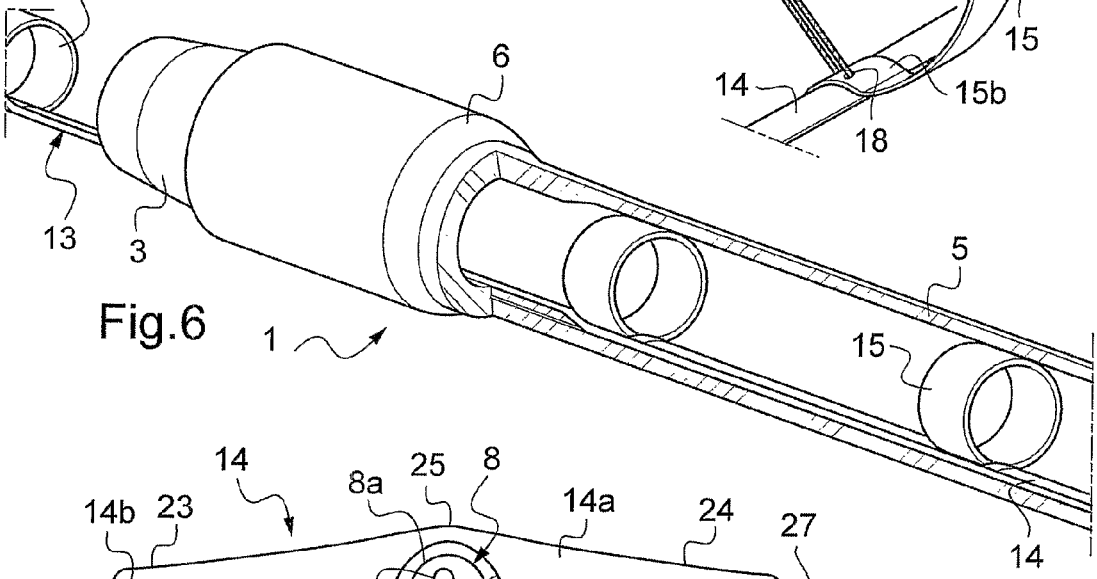
Fig.6
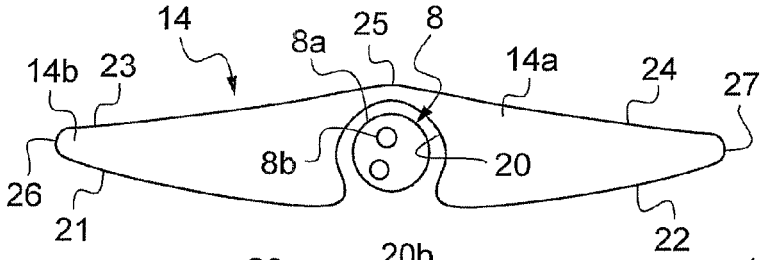
Fig.7
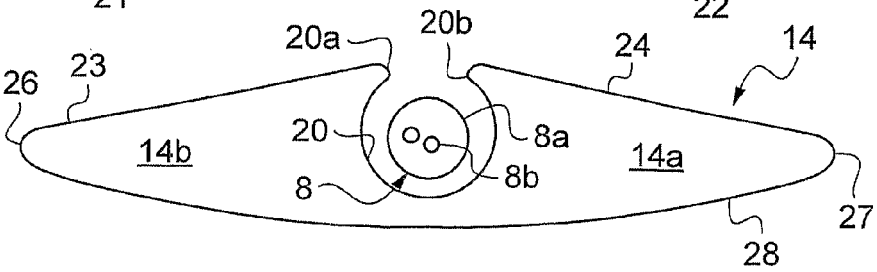
Fig.8
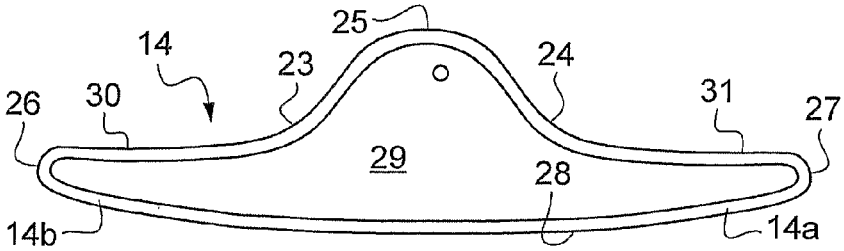
Fig.9

HOLDING DEVICE INSERTABLE INTO THE CENTRAL BORE OF A TUBULAR DRILL STRING COMPONENT, AND CORRESPONDING TUBULAR DRILL STRING COMPONENT

The invention relates to oil and gas drilling, and more particularly to the devices and tools for transmitting information along drill strings.

Tubular drill string components comprise without limitation drill pipe, heavy weight drill pipe, bottom hole assembly, subs, kelly.

In the oil & gas drilling industry, various sensors are used to take measurements with respect to downhole geological formations, status of downhole tools, operational conditions, etc.

The measurements data are useful for operators and engineers located at the surface. The measurements may be taken at various points along the drill string. The measurements data may be used to determine drilling parameters, such as the drilling direction, penetration speed, and the like, to accurately tap into an oil, gas or other mineral bearing reservoir.

The measurements data should be transmitted to the earth surface. Traditional methods of transmission such as mud pulse have very low data rates. Efforts have been made to transmit data along transmission lines such as for example electrical cables, integrated directly into drill string components, such as sections of drill pipe.

Electrical contact or other transmission elements such as electromagnetic induction couplers are used to transmit data across tool joints or connection joints in the drill string.

Accommodating a transmission line in a channel formed within the wall of a string component may weaken the wall when such wall is thin, for example in the central portion of a drill pipe or when the wall is thicker in a current portion (heavy weight drill pipe, drill collar . . . ) but is locally thinner and cannot tolerate a channel therein. Mounting the transmission line though the central bore against the wall exposes the transmission line to drilling fluids and tools or other substances or objects passing through the central bore. This can damage the transmission line.

The drill string sections may be bent, for example, in a horizontal drilling. The transmission line may be damaged by the bending if the transmission line is attached to the wall by an adhesive coating which may crack or may be deviated away from the inside surface of the central bore if it is not protected by an adhesive coating.

It is known to use a liner insertable into the bore of a drill string component. But, the liner cannot be easily accommodated within the central bore, particularly when the drill string component has a small diameter proximate its ends. The liner is reducing the current section of the drill string component thus increasing the loss of head in the string.

The invention provides a significant improvement to downhole drilling strings equipped with information transmission.

In view of the foregoing, a holding device is insertable into the central bore of a drill string component. The central bore has a first diameter along a central portion of the drill string component and a second diameter proximate the ends of the drill string component, the second diameter being lower than the first diameter. The holding device includes an elongated body forming at least partly a housing for a transmission line, said elongated body having transversal dimensions lower than the second diameter, and a plurality of arcuate elements arranged along the elongated body and distinct from and attached to the elongated body. The arcuate elements are elastically bendable so as to be able to move through the second diameter and have a largest chord greater than the first diameter in a free state so as to be able to expand within the first diameter once past the second diameter.

A tubular drill string component comprises a tubular member and a holding device inserted therein. The tubular member comprises a central bore having a first diameter along a central portion of the tubular member and the second diameter proximate the ends of the tubular member, the second diameter being lower than the first diameter, and the holding device insertable into the central bore of the tubular member. The holding device includes an elongated body forming at least partly a housing for a transmission line, said elongated body having transversal dimensions lower than the second diameter, and a plurality of arcuate elements arranged along the elongated body and distinct from and attached to said elongated body. The arcuate elements are elastically bendable so as to be movable through the second diameter and have a largest chord greater than the first diameter in a free state so as to expand within the first diameter once past the second diameter.

In one embodiment, the arcuate elements have a developed length larger than the internal perimeter of the central portion of a tube but their ends are distant.

The invention will be better understood and will become fully apparent from the following description, and drawings. These drawings depict only typical non-limitative embodiments.

FIG. 4 is a perspective view illustrating an arcuate member mounted on a body.

FIG. 5 is a perspective view showing an arcuate member and a diameter reduction element.

FIG. 6 is a perspective view illustrating insertion of the holding device into a drill string component.

FIG. 7 is a transversal view illustrating an embodiment of an elongated body.

FIG. 8 is a transversal view illustrating an embodiment of an elongated body.

FIG. 9 is a transversal view illustrating an embodiment of an elongated body.

Figure 1:
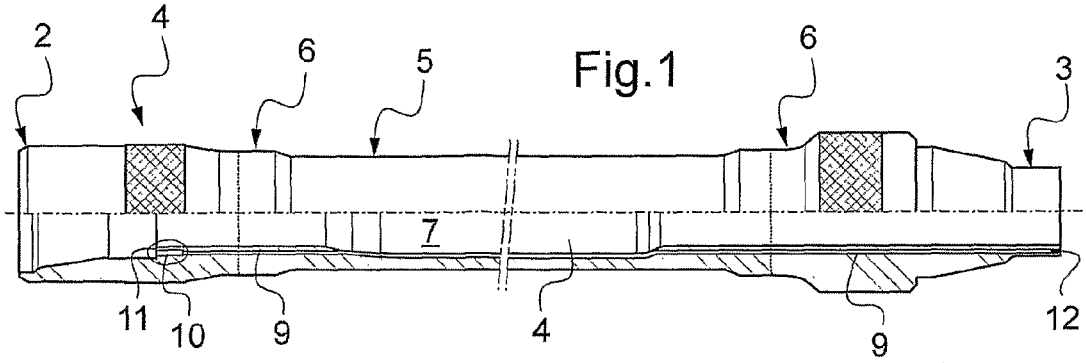
FIG. 1 is a cross sectional view illustrating an embodiment of a drill string component.

It will be readily understood that the components as general described and illustrated in the figures herein, could be arranged and designed in a wide variety of different configurations. The following more detailed description of devices of the present invention, as represented in the figures, is not intended to limit the scope of the invention as claimed, but is merely representative of various selected embodiments of the invention and may optionally serve as a contribution of the definition of the invention.

The illustrated embodiments of the invention will be better understood by reference to the drawings, wherein same parts are designated by same numerals throughout.

Those of ordinary skilled in the art will, of course, appreciate that various modifications to the devices described herein may easily be made without departing from the essential characteristics of the invention, as described in connection with the figures.

Thus, the following description of the figures is intended only by way of examples, and simply illustrates some selected embodiments consistent with the invention as claimed herein.

A drill rig is used to support drill string components so as to drill bore hole into the earth. Several drill string components form at least a portion of a drill string. In operation, a drilling fluid is typically supplied under pressure at the drill rig through the drill string. The drill string may be rotated by the drill rig to turn a drill bit mounted at the lower end of the drill string.

The pressurized drilling fluid is circulated towards the lower end of the drill string in a bore thereof and back towards the surface outside the drill string to provide the flushing action to carry the drilled earth cuttings to the surface. Rotation of the drill bit may alternately be provided by other drill string components such has drill motors or drill turbines located adjacent to the drill bit. Other drill string components include drill pipe and downhole instrumentation such as logging while drilling tools and sensor packages. Other useful drill string components includes stabilizers, hole openers, drill collars, heavy weight drill pipe, subassemblies, under reamers, rotary steerable systems, drilling jars and drilling shock absorbers, which are well known in the drilling industry.

The document US 2005/0115017 concerns a liner insertable into the central bore of a drill string component. The liner includes a resilient material initially in a form of a rectangular sheet held into a substantially cylindrical shape. The outside diameter of the liner is variable to allow the liner to be inserted into a narrowed bore of the drill string component near the box end or pin end.

Once past the narrowed bore, the outside diameter of the liner self expands within the central bore of the drill string component. The outside diameter of the liner may expand to contact the inside surface of the central bore. The ends of the liner are then overlapping. The content of this document is included herein by reference.

One can also refer to U.S. Pat. No. 6,516,506 which also discloses a liner rolled in a cylindrical shape from a rectangular sheet and having overlapping ends.

The insertion into the bore of the liner is quite difficult due the stiffness of the cylindrical liner.

Moreover, due to its overlapping ends the liner is somewhat reducing the flowing section thus increasing the loss of head of the drilling fluid in the drill string.

Another drawback is that in case of bending loads exerted on the drill pipe the liner may detach from the drill pipe internal surface on the extrados and may form transverse folds on the intrados, which increases the loss of head.

Still another drawback is that the liner may axially move and generate wear on the drill pipe internal surface in case of axial vibrations or jarring loads.

An aim of the invention is to make the transmission line stay during the drilling process.

Another aim of the invention is to obtain a protecting and holding device for a transmission line which can easily be inserted in the bore of a drill string component.

Referring to FIG. 1, a drill pipe 1 may include pipe having upset ends and a tool joint attached by welding to each upset end. A tool joint constitutes a box end 2. The other tool joint constitutes a pin end 3. The pin end 3 of a drill pipe may thread into a box end 2 of another drill pipe, thereby connecting multiple drill pipes to form a drill string. The drill pipe 1 is provided with a longitudinal bore 4 which runs through the tool joint 2, the pipe and the tool joint 3. The bore 4 is used to transport drilling fluids, wire line tools, and the like down the drill string.

The wall thickness around the bore 4 is typically designed in accordance with weight, strength and other constraints needed to withstand substantial torque placed on the drill pipe 1, pressure within the bore 4, flex in the drill pipe 1, and the like.

Because of large forces exerted on the drill pipe 1, providing a channel in the wall of the drill pipe 1 to accommodate a transmission line such as for example electrical wirings or an electrical cable or optical fibers may excessively weaken the wall. It is proposed to place the transmission line at least partly through the bore 4 of the drill pipe 1. Accommodating a transmission line through the bore 4 may expose the transmission line to drilling fluids, cements, wire line tools, or other substances or objects passing through the bore 4. This can damage the transmission line or cause the transmission line to negatively interfere with objects or substances passing through the bore 4. Thus, a transmission line may be maintained close to the wall of the bore 4 to minimize interference.

The drill pipe 1 includes a central part 5, a first intermediary part 6 between the box end 2 and the central part 5 which includes an upset pipe end and the tool joint welded end, and a second intermediary part 6 between the pin end 3 and the central part 5 which includes another upset pipe end and the other tool joint welded end. The internal surface 7 of the central part 5 defines a central bore in which the transmission line 8 is introduced. The transmission line 8 or at least some portions of it, for example between the hole 9 and the holding device, may include a protection tube 8*a*. The internal surface 7 is a part of the bore 4. The external diameter of each intermediary part 6 may increase from the external diameter of the central part 5 to the external diameter of the tool joints at ends 2, 3.

The internal diameter of the intermediary part 6 is lower than the diameter of the internal surface 7 of the central part 5. In other terms, the thickness of the wall of the intermediary part 6 is significantly greater than the thickness of the wall of the central part 5. A hole 9 parallel to the longitudinal bore 4 may be provided in the wall of the intermediary part 6 and also in the wall of the pin end 3 to accommodate the transmission line 8, without overly weakening the intermediary parts 6. Holes 9 or gun drill holes may be machined in the first and second intermediary parts 6. The holes 9 can be machined by turning or milling.

On the side of the box end 2, the hole 9 may be in communication with a circular groove 10 provided in a shoulder 11 between an intermediary part portion of the longitudinal bore 4 and a female thread. On the side of the hole 9 opposite to the groove 11, the hole 9 is in communication with the longitudinal bore 4 while being substantially flush with the internal surface 7.

The hole 9 proximate the pin end 3 is in communication with the longitudinal bore 4 in the intermediary part 6. The hole 9 may be flush with the internal surface 7. More precisely, the surface of the hole 9 proximate the outer diameter of the intermediary part 6 may be flush with the internal surface 7.

On the side opposite to the internal surface 7, the hole 9 is in communication with a circular groove 12 provided at the free end of the pin end 3. The grooves 11 and 12 may accommodate windings and coupling devices such as those disclosed in documents U.S. Pat. No. 6,641,434 or U.S. Pat. No. 6,670,880, the content thereof is incorporated by reference, so as to obtain an electromagnetic coupling between two adjacent transmission lines.

Figure 2:
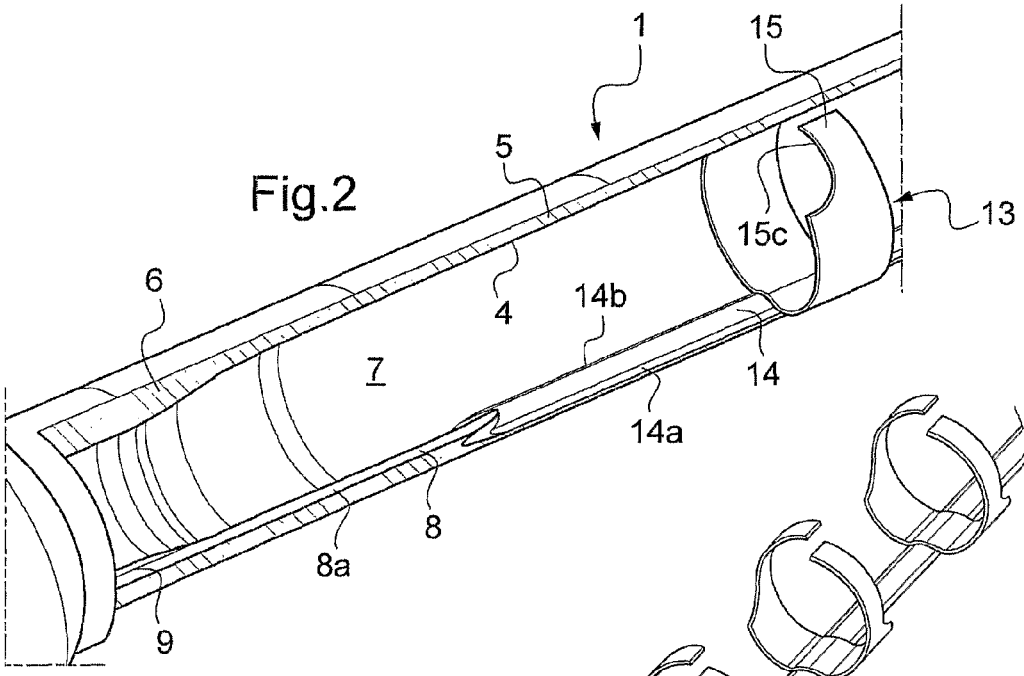
FIG. 2 is a perspective view illustrating a holding device into a drill string component.

Referring to FIG. 2, the drill pipe 1 includes a holding device 13 arranged within the longitudinal bore 4, on the internal surface 7 of the central part 5.

The holding device 13 includes a longitudinal body 14. The body 14 is mainly longitudinal and may have an angle with regard to the geometrical axis of the drill pipe 1. In other terms, the body 14 may be slightly helical, for example with an helix angle lower that 1 turn of helix along the central part 5. The body 14 may be realised as a single piece from one end to the other. The elongated body 14 may be made of metal, for example type AISI 304L stainless steel, bare or coated, or of plastics or of composite, for example fiber reinforced composite.

The elongated body 14 may be bonded to the internal surface 7, for example by means of glue. The glue may be of epoxy type or any other synthetic material polymerizable by curing. The elongated body 14 has an arcuate surface in contact with the internal surface 7 with a radius substantially equal to the radius of the internal surface 7. In a variant, the radius of curvature of the arcuate surface may be greater than the curvature of the radius of the internal surface 7 so as to better retain the transmission line 8 during inserting the holding device 13 into the bore 4. The elongated body has a longitudinal groove 20 forming a housing for the transmission line 8. The elongated body 14 may have a fixed length slightly shorter than the minimum actual length of central part 5. The transmission line, for example including a pair of electrical wires 8*b*, runs inside a small tube 8*a* inserted into the holes 9 in the intermediary parts 6 so that the small tube 8*a* may protect the electrical wires 8*b* at least between each hole 9 and the longitudinal body 14.

The groove 20 may be formed in the center of the arcuate surface. The groove 20 is dividing the arcuate surface into substantially symmetrical portions. The groove 20 may have a cross section larger at a first distance from the internal surface 7 than the cross section at a second distance from the internal surface 7, the second distance being lower than the first distance, so as to retain the transmission line 8. In other terms, the elongated body 14 may include retaining lips configured to maintain the transmission line 8 in the groove 20.

The elongated body 14 may include two lateral aisles 14*a*, 14*b* opposite to the internal surface 7. The cross section of the elongated body 14 may have a central convex portion, two lateral concaves portions and two convex ends. The transversal dimension of the body 14 is lower that the internal diameter of the intermediary part 6, either before mounting or in a final state. The angular dimension of the body 14 is lower than 120°, preferably lower than 60°.

The holding device 13 also includes a plurality of arcuate elements 15. In one embodiment, the arcuate elements 15 are secured to the elongated body 14, for example by snap fitting, by bonding such as welding, spot welding, brazing or gluing or by riveting or bolting. The arcuate elements 15 are apart the one from the others. The arcuate elements 15 may be regularly spaced along the body 14.

The arcuate elements 15 may have a low thickness, more particularly between 0.1 mm and 2 mm, for example 0.4 mm. The arcuate elements 15 may be made of a resilient material such as for example spring steel, precipitation hardened stainless steel such as 17.7PH, cold work stainless steel, Cu—Be alloy, synthetic material such as PEEK or composite such as fiber reinforced composite. A preferential solution could be 17.7PH stainless steel arcuate elements welded on a 304L stainless steel elongated body. If the arcuate elements are made of metal, they may be coated in particular if their material is sensitive to rust for improving other properties.

An arcuate element may have a length between 10 mm and 100 mm measured along the drill pipe axis. The distance between two successive arcuate elements on the same side of the longitudinal body can be comprised between 500 mm and 3000 mm.

The arcuate elements 15 may have an angle between 180° and 360° in a free state. The free state of an arcuate element means before mounting the holding device 13 in a drill pipe 1 or before exerting force by another element, for example as shown on FIG. 5, on the arcuate element 15.

In a final position, for example shown on FIG. 2, the arcuate elements may occupy an angle between 210 and 300°. In an embodiment, the arcuate elements occupy an angle larger than 360°.

The perimeter of the arcuate element 15 depends on the internal diameter of the internal surface 7 to which it is intended to be mounted. As the arcuate elements 15 have their diameter determined by the diameter of the internal surface 7 in a final state under elastic deformation, the arcuate elements 15 exert a radial force directed opposite the geometrical center. Said radial force is supported by the internal surface 7 and by the elongated body 14. Then, the elongated body 14 is maintained is contact with the internal surface 7 by the elastic radial force of the arcuate elements 15. The choice of a high yield strength material, for example a material having a yield strength higher than 500 MPa, and a large angle higher than 360° for the arcuate elements enables to get a high radial contact force between the elongated body 14 and the internal surface 7.

The arcuate elements 15 may have a rectangular shape (see for example FIGS. 4 to 5) when completely unrolled or developed.

Figure 3:
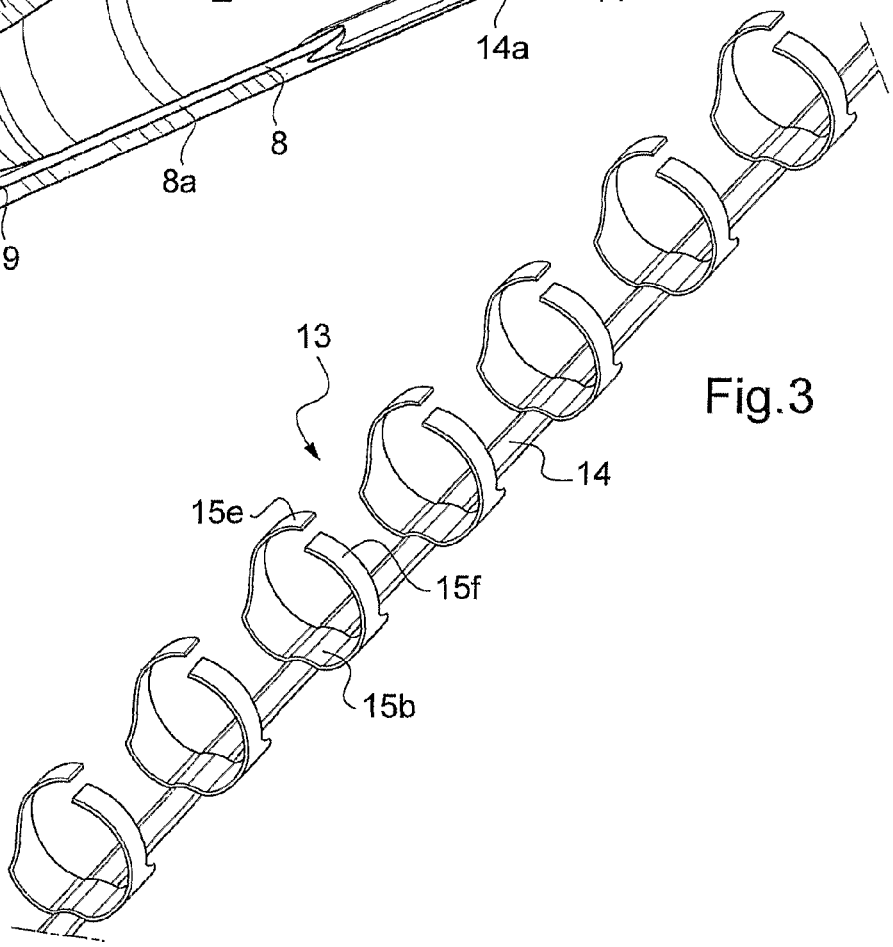
FIG. 3, is a perspective view illustrating a holding device in a free state.

On FIGS. 2 and 3, the arcuate elements 15 have a cutout 15*c* in a corner of one end and a corresponding cut-out in the opposite corner of the arcuate element other end. The cutout 15*c* has a function of allowing high values of angle, larger than 360°, for the arcuate elements without overlapping of its ends. In other terms, the ends of the arcuate elements are distant one to another. Said ends may be longitudinally spaced. Such feature results in large contact force between the elongated body 14 and the internal surface 7 without high loss of head of drilling mud. Each arcuate element 15 is maintaining the elongated body 14 in contact with the internal surface 7 by elastic springback force. As the angle occupied by the arcuate elements 15 is greater in the final position in the internal surface 7 than in the free state, the arcuate elements 15 exert a radial force towards the internal surface 7. Each arcuate element 15 may maintain a part of the elongated body 14. A series of arcuate elements 15 disposed at substantially equal distances is maintaining the elongated body 14 very strongly. Also a plurality of arcuate elements 15 is less stiff than a liner and makes thus insertion of the holding device easier.

Such holding device with arcuate elements is also more tolerant to bending loads than a liner.

Referring to FIG. 3, a central portion of the holding device 13 is shown with the arcuate elements 15 in a free state. The angular distance between the ends of the arcuate element 15 is between 20° and 40°. The holding device 13 is shown in a free state. The arcuate elements 15 each have a part 15*e* with a cut-out along one side of one C-wing of the arcuate element 15, an opposite end part 15*f* of with a cut-out along the other side of the other C-wing of the arcuate element 15 and a central part 15*b* in contact with the elongated body 14. The cut-outs may prevent a contact or avoid overlapping between end parts 15*e* and 15*f*, for example during insertion.

Referring to FIG. 4, the arcuate elements 15 have a rectangular shape when unrolled. The arcuate elements 15 have a main portion 15*a* having a diameter adaptable to the internal surface 7 and an end portion 15*b* of reverse convexity in contact with and secured to the surface of the elongated body 14 opposite to the internal surface 7. On the contrary, in the embodiment of FIG. 2, the arcuate elements 15 have a substantially central portion 15*b* in contact with the elongated body 14 and two lateral portions in contact with the internal surface 7.

Referring to FIG. 5, the arcuate element 15 is similar to the one of FIG. 4. A restraining element 16, for example a rope or string in an easily melting material such as thermoplastics, is accommodated between locations 17 on the free end of the main part 15*a* and 18 on the end portion 15*b* in contact with the elongated body 14 so as to maintain the arcuate element 15 in a reduced diameter state. Holes may be provided at-least one of locations 17, 18 to facilitate accommodation of the rope. The rope may in place be secured by means of a glue. In the reduced diameter state shown on FIG. 5, the arcuate element 15 may go through the internal diameter of the intermediary part 6 of the drill pipe 1 having a diameter lower than the diameter of the central part 5. The restraining element 16 may be dismounted, for example by heating at a temperature beyond the softening point or the melting point of the material of restraining element 16, when the holding device 13 is within the internal surface 7 of the central part 5. The dismounting may occur while curing for polymerizing a glue provided to attach the holding element 13 to the internal surface 7. A layer of polymerizable glue may therefore be applied on the surface 7 of the internal bore or on part or all facing surface of the holding device 13. Such curing may be obtained by circulating hot air through bore 4. The rope 16 may be used in other embodiments, for example with the arcuate elements of FIGS. 2, 3 to restrain their maximum chord or diameter before a final state.

Referring to FIG. 6, the holding device 13 is shown during insertion in the drill pipe 1, by the pin end 3. The arcuate elements 15 may have their opposite ends brought in contact, for example by the restraining element 16. The outer diameter of the arcuate elements 15 is reduced so as to be able to be inserted in the longitudinal bore 4 and going through the internal diameter of the intermediate part 6. The perimeter of the arcuate elements can be chosen in order for the opposite ends of the arcuate elements not to overlap when they are inserted through the internal diameter of the intermediate part 6. The corresponding cutouts 15*c* disclosed in FIGS. 2 and 3 may be useful to prevent an overlapping while providing a sufficient perimeter for the arcuate elements.

Referring to FIG. 7, the elongated body 14 is obtained from a profile or a strip. It has a central groove 20 forming a housing for the transmission line 8 and two lateral surfaces 21, 22 having a radius adapted to the internal surface 7. The radius is substantially equal to the diameter of the internal surface 7 at the central part of the drill pipe and thus depends on the drill pipe diameter. On the opposite side, the elongated body 14 has two surfaces 23 and 24 slightly concave and a central convex surface 25, between the concave surfaces 23 and 24. End opposite surfaces 26 and 27 are disposed between the lateral surface 21 and the concave surface 23 and symmetrical rounded surface 27 is arranged between the arcuate surface 22 and the concave surface 24. The aisles 14*a* and 14*b* are respectively defined by surfaces 22, 24 and 17, and 21, 23 and 26.

Referring to FIG. 8, the elongated body 14 also obtained from a profile has a single arcuate surface 28 configured to be in contact with the internal surface 7, two opposite rounded surfaces 26 and 27 having a small radius of curvature, two convex surfaces 23 and 24 having a large radius and a central groove 20 between the convex surfaces 23 and 24 and opposite the internal surface 7 of the drill pipe 1. The groove 20 may be partially closed by the arcuate elements 15 thus lowering the risk of having the transmission line 8 escaping from the groove 20.

Moreover, the groove 20 has an aperture lower than the aperture of the embodiment illustrated on FIG. 8. More precisely, the transmission line cooperating with the elongated body 14 is maintained between the groove 20 and the internal surface 7. The transmission line arranged in the groove 20 of the elongated body 14 of the embodiment illustrated on FIG. 9 is maintained by the lips 20*a*, 20*b* of the groove 20. The distance between the lips 20*a* and 20*b* may be less than 70% of the diameter of the groove 20.

Referring to FIG. 9, the elongated body 14 is deprived of groove. The elongated body 14 has a tubular structure with a longitudinal hole 29 in which the transmission line 8 may be mounted. The transmission line 8 may be completely protected by the elongated body 14 at least in a central portion of the elongated body 14. The thickness of the wall of the elongated body 14 may be slightly constant. The elongated body 14 has a single surface 28 configured to be in contact with the internal surface 7 of the drill pipe 1, two rounded end surfaces 26, 27, two substantially straight surfaces 30, 31, two concaves surfaces 23, 24 and a central convex surface 25 between the concave surfaces 23 and 24. The elongated body 14 may be substantially symmetrical with regard to a longitudinal plane, for example coaxial with the drill pipe 1.

Even if the drawings hereabove described represent a drill string component which is a drill pipe and has a first diameter along all the central portion of the drill pipe, i.e. all the length of the drill pipe excepted its ends, the present invention also applies when the portion having a first diameter corresponds to part of the central portion of the component, said part being located near an end of the drill string component.

The invention claimed is:

1. A drill string component, comprising:

a holding device inserted into a central bore of the drill string component, the central bore having a first diameter along at least part of a central portion of the drill string component and a second diameter proximate ends of the drill string component, the second diameter being lower than the first diameter, the holding device comprising:

an elongated body forming at least partly a housing for a transmission line, the elongated body having transversal dimensions lower than the second diameter; and a plurality of distinct arcuate elements arranged along the elongated body and distinct from and attached to the elongated body, the arcuate elements being elastically bendable to be able to move through the second diameter and having a largest chord greater than the first diameter in a free state to be able to expand within the first diameter once past the second diameter, each arcuate element being independently and freely movable relative to the other arcuate elements.

2. A holding device according to claim 1, wherein the arcuate elements have an angle between 180° and 360° in a free state.

3. A holding device according to claim 1, wherein ends of the arcuate elements each include a cutout in a longitudinal position of an opposite end of the arcuate element.

4. A holding device according to claim 1, wherein the elongated body comprises two convex surfaces, the housing being arranged therebetween.

5. A holding device according to claim 1, wherein the elongated body comprises two lateral aisles opposite the housing.

6. A holding device according to claim 1, wherein the elongated body is obtained from a profile and the housing is a longitudinal channel.

7. A holding device according to claim 1, wherein the elongated body has a tubular shape, an inside of the tubular shape forming the housing.

8. A holding device according to claim 1, wherein the holding device includes a restraining element secured to the transverse ends of the arcuate elements to keep a maximum chord of the arcuate elements less than the second diameter in a restrained state before and during insertion of the holding device inside the drill string component.

9. A holding device according to claim 8, wherein the restraining element includes a rope in a thermoplastic material.

10. A method to install the holding device of claim 8, comprising:

inserting the holding device in the central portion of the tubular drill string component having the first diameter as an inner diameter; and flowing hot air with the bore of the tubular drill string component to rupture the rope and let the arcuate elements expand against the first diameter portion.

11. A holding device according to claim 1, wherein the arcuate elements have ends which are only in contact with the central bore.

12. A holding device according to claim 1, wherein a space between two successive arcuate elements is between 500 and 3000 mm.

13. A holding device according to claim 1, wherein a length along a drill pipe axis of the arcuate elements is between 10 and 100 mm.

14. A tubular drill string component comprising:

a tubular member and a holding device inserted therein;

the tubular member comprising a central bore having a first diameter along a central portion of the tubular member and a second diameter proximate ends of the tubular member, the second diameter being lower than the first diameter;

the holding device is insertable into the central bore of the tubular member, wherein the holding device includes an elongated body forming at least partly a housing for a transmission line, the elongated body having transversal dimensions lower than the second diameter, and a plurality of distinct arcuate elements arranged along the elongated body and distinct from and attached to the elongated body, the arcuate elements being elastically bendable so as to be movable through the second diameter, having a largest chord greater than the first diameter in a free state to expand within the first diameter once past the second diameter, each arcuate element being independently and freely movable relative to the other arcuate elements.

15. A tubular drill string component according to claim 14, wherein the arcuate elements maintain the elongated body against the first diameter portion of the central bore by elastic springback force, the arcuate elements exerting a radial force on a surface of the first diameter portion.

16. A tubular drill string component according to claim 14, wherein the elongated body comprises two convex surfaces, the convex surfaces having a curvature adapted to the first diameter.

17. A holding device according to claim 14, wherein the elongated body comprises two lateral aisles opposite the housing, the aisles being in contact with a surface of the first diameter portion.

18. A holding device according to claim 14, wherein the arcuate elements have ends arranged distant one to another in a final position after insertion within the first diameter portion of the central bore.

19. A holding device according to claim 18, wherein the arcuate elements have ends arranged to be just in contact or distant one to another during insertion through the portion of the central bore having a second diameter.

20. A holding device according to claim 14, wherein the arcuate elements have an angle of more than 360° in a final position.

21. A holding device according to claim 14, wherein the arcuate elements have ends which are only in contact with the central bore.

22. A holding device according to claim 14, wherein a space between two successive arcuate elements is between 500 and 3000 mm.

23. A holding device according to claim 14, wherein a length along a drill pipe axis of the arcuate elements is between 10 and 100 mm.

* * * * *